United States Patent [19]

Krull

[11] Patent Number: 4,526,488

[45] Date of Patent: Jul. 2, 1985

[54] INK RIBBON CASSETTE PROVIDED WITH AN IMPREGNATION DEVICE

[75] Inventor: Joachim Krull, Siegen, Fed. Rep. of Germany

[73] Assignee: U.S. Philips Corporation, New York, N.Y.

[21] Appl. No.: 539,873

[22] Filed: Oct. 7, 1983

[30] Foreign Application Priority Data

Oct. 7, 1982 [DE] Fed. Rep. of Germany ..... 3237122

[51] Int. Cl.[3] ..... B41J 31/16; B41J 32/02

[52] U.S. Cl. ..... 400/202.4; 400/196; 400/208

[58] Field of Search ..... 400/202.2, 202.3, 202.4, 400/197, 198, 199, 200, 201, 202, 202.1, 194, 195, 196, 196.1, 207, 208, 208.1, 470, 471, 471.1; 222/160, 161, 162

[56] References Cited

U.S. PATENT DOCUMENTS 2,761,539 9/1956 Furman et al. ..... 400/202.1

FOREIGN PATENT DOCUMENTS 0031854 7/1981 European Pat. Off. ..... 400/208

*Primary Examiner*—Edgar S. Burr
*Assistant Examiner*—Charles A. Pearson
*Attorney, Agent, or Firm*—Robert S. Smith

[57] ABSTRACT

The invention relates to an ink ribbon cassette with an impregnation device for printers, in which a container for the ink liquid has in its interior a threshold, across which flows the ink liquid at increased acceleration. One end of an extraction tube opens into the surface of the threshold, the other end of this tube terminating above and adjacent to a roller of sponge or felt. Efficaciously, the threshold forms part of a constriction, through which the ink liquid is urged. The constriction may be formed in that two cavities having narrowing cross-sections face each other or in that a tube is arranged in the container.

7 Claims, 7 Drawing Figures

INK RIBBON CASSETTE PROVIDED WITH AN IMPREGNATION DEVICE

Figure 1:
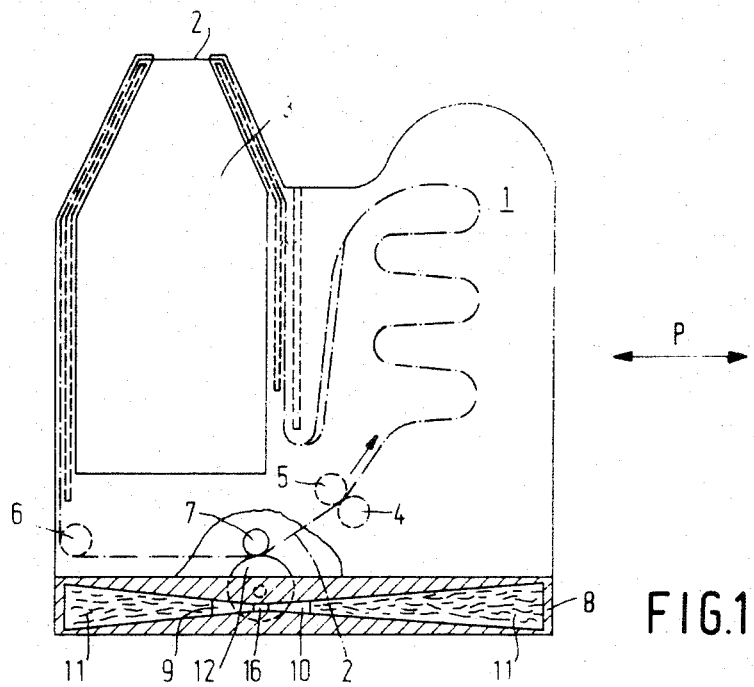

The invention relates to an ink ribbon cassette provided with an impregnation device for the ink ribbon, which can be placed on the carriage of a printer and in which the ink liquid that can be fed into a container can be supplied to a wettable roller, over which the ink ribbon is guided and which is rotatable by the movement of the ink ribbon.

Such an ink ribbon cassette is known from European Patent Application No. 0 031 854. An ink receptacle is disposed above each of two ink ribbon spools so that the ink ribbon before the printing area is impregnated in both directions of transport of the ink ribbon with ink liquid. The ink receptacles consist of felt and are separated from the remaining part of the cassette housing. Between the spool body and the printing area the ink ribbon is guided over a roller with a hard surface. This roller is connected via a rectangularly bent part to the associated ink receptacle. The roller is rotated by the moving ink ribbon so that the surface of the roller is continuously wetted with ink liquid. In order that an excess of ink liquid does not emanate through the bearings of a roller shaft, the radial limiting surfaces of the roller are provided with annular recesses serving to stop the flow.

It is disadvantageous that when the ink ribbon is not moved, ink liquid can reach the roller due to gravity. For this reason, particular precautions have to be taken to prevent the ink receptacles from being excessively enriched with ink liquid. Further, such ink ribbon cassettes cannot be kept on stock because then ink liquid can also flow out.

The invention has for its object to provide an ink ribbon cassette with an impregnation device, in which ink liquid can be extracted from an ink container only during the movement of the printing head provided with the ink ribbon cassette and which has a simple construction.

This is achieved in that the container has an inwardly protruding threshold, into an upper part of which opens one end of an extraction tube, whilst the other end of the extraction tube is adjacent to the roller and in that the liquid level lies below the upper part of the threshold.

The invention has the advantage that ink liquid is supplied to the sponge roller and hence to the ink ribbon only when the liquid level is moved and the liquid flows across the threshold. With a comparatively steadily moved printing head changes its direction of movement, i.e. at the beginning and the end of a writing line. The amount of ink which flows across the threshold depends on the one hand upon the vibrations during movement and on the other hand upon the height of the threshold with respect to the level of the liquid. The invention ensures a metered supply of the ink liquid.

In order to insure that ink liquid penetrates into the extraction tube and is not washed away across its opening, the space above the threshold and hence above the opening of the extraction tube is constricted. According to a further embodiment of the invention, this is achieved in that inside the container two cavities are formed with narrowing cross-sections, a threshold being constituted by the two adjacent smallest cross-sections of said cavities, said cavities being connected by an air relief duct.

Instead of these cavities being narrowed on all sides so that the housing is in the form of a sand-hourglass, a stationary short tube may also be used, within which the threshold is provided or which is placed on a threshold itself. The tube is arranged in the housing so that its longitudinal axis extends parallel to and above the liquid level. In this case, a separate air relief inside the container is superfluous. It is efficacious to slightly raise laterally the threshold located inside or outside the tube so that the ink liquid set into motion is guided towards the opening of the extraction tube.

Figure 2A:
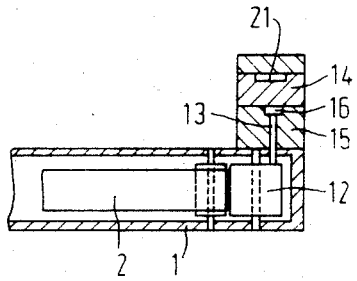
Figure 2B:
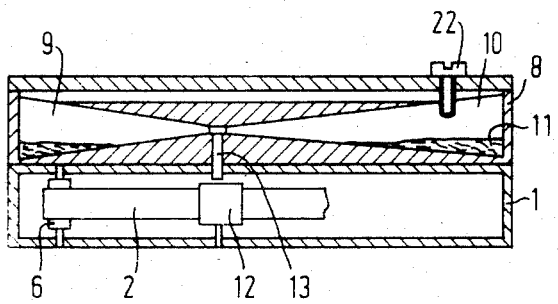
Figures 3A, 3B:
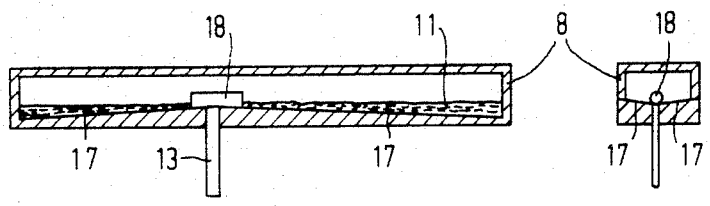
Figures 4A, 4B:
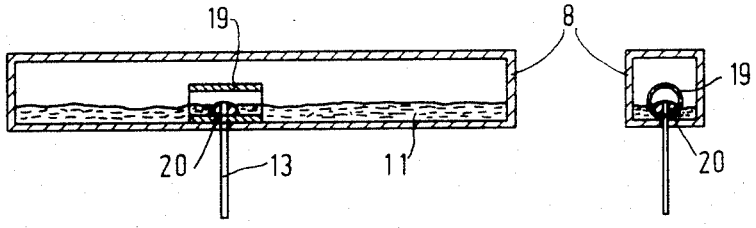

The invention will now be described more fully, by way of example, with referencwe to the accompanying drawings, in which:

FIG. 1 shows an ink ribbon cassette provided with an impregnation device according to the invention, FIG. 2 shows details of the arrangement shown in FIG. 1, FIG. 3 shows a further embodiment of the after-impregnation device, and FIG. 4 shows another embodiment of the after-impregnation device.

The ink ribbon cassette 1 shown in plan view in FIG. 1 is placed on a carriage of a printer (not shown) in a known manner not described further in such a way that a printing head comes to lie in the space 3. There is arranged inside the ink ribbon cassette 1 an endless ink ribbon 2 which is moved in the direction of the arrow by the driving gear and the pressure roller 5 which cooperates with an idler roller 4. The ink ribbon 2 is then pulled around a guide roller 6 and a counter roller 7. The impregnation device is secured on the rear end of the ink ribbon cassette 1. This device comprises a container 8 and a roller 12. The roller 12 is journalled in the ink ribbon cassette 1 and co-operates with the counter roller 7. The container 8 is provided in the interior with two cavities 9 and 10, whose cross-sections are narrowing and which face each other with their smallest cross-sections. At this area they constitute a threshold 16 into which opens an extraction tube 13. The two cavities 9 and 10 may be in the form of a bottle or of a hollow pyramid or a hollow cone. It is essential that there is provided at the narrowed part a threshold or constriction. Efficaciously, a diameter of this constriction of 1.5 mm and a length of about 2 mm are chosen. In order that ink liquid 11 can be fed to a sufficient extent into the cavities 9 and 10, the lower side of this threshold 16 is located, viewed from the bottom of the cavities 9 and 10, approximately at the centre of the container 8 if this container has a diameter or a side of 11 mm. Efficaciously, the container 8 is composed of two parts, i.e. an upper container part and a lower container part 14 and 15, respectively. After the feeding screw 22 has been unscrewed, ink liquid 11 can be replenished or fed through the opening then obtained. It has then to be ensured that the liquid level does not surpass the upper side of the threshold 16. The two cavities 9 and 10 in addition communicate with each other via an air relief duct 21.

During printing, the printing head and the ink ribbon cassette are moved to and fro in the direction of the arrow P. When at the termination points of the movement the direction is reversed, an acceleration is invariably obtained. As a result, the ink liquid 11 flows to and fro across the threshold 16. The pressure produced in this constriction then also urges a small part of the ink liquid into the extraction tube 13, from which the liquid reaches the sponge roller 12. The extraction tube 13 consequently terminates a short distance above the upper lateral limiting surface of the sponge roller 12. When the ink liquid flows across the threshold 16, a small part of the ink thus drips onto the sponge roller 12, which transfers this ink to the ink ribbon 2. The size of the constriction and the diameter of the extraction tube 13 depend upon the kind of ink used and upon the desired blackening of the copy.

When the printer is stopped, accelerations are no longer obtained and the supply of ink liquid to the extraction tube 13 is terminated. Furthermore, no ink liquid flows out through the area at which the ink ribbon cassette is journalled in some arbitrary shaft. Extraction of ink liquid can be obtained only by abrupt movements in the longitudinal direction of the container 8 in horizontal position.

FIGS. 3 and 4 show two further embodiments of the container 8 of FIG. 1. In the embodiment of FIG. 3, the threshold 16 is constituted by the crest of two inclined surfaces 17 which decline on each side. On this crest is secured a tube 18 whose longitudinal direction coincides with the longitudinal direction of the container 8 or extends parallel thereto. In order to ensure that a largest possible quantity of ink liquid 11 is passed through the tube 18 when the direction of movement is reversed, the crest of the inclined surfaces 17 is offset with respect to extraction tube 13, and, thus, the surfaces 17 also decline laterally towards the tube 18.

In the embodiment of FIG. 4, there is secured inside the container 8 a tube 19, within which the threshold 20 is provided. In order that it is ensured that a largest possible quantity of ink liquid is passed through the tube 19, it is efficacious that the tube 19 approximately covers the inner cross-section of the container 8. For the same reason, it is efficacious to construct the threshold 20, viewed in the longitudinal direction of the container 8, so as to be laterally offset with respect to extraction tube 13. In this context longitudinal refers to the direction of elongation, and lateral refers to the direction at right angles thereto.

What is claimed is:

1. An ink ribbon cassette for use with a printer having a carriage, said cassette being provided with an ink impregnation device for the ink ribbon, said cassette being mountable on the carriage of the printer, said cassette having a container which contains liquid ink, said ink being supplied to a wettable roller over which the ink ribbon is guided, said wettable roller being rotated by the movement of the ink ribbon, said container having a protruding threshold, an extraction tube having one end which opens into said threshold, another end of said extraction tube being located adjacent to said wettable roller so that ink flows from the extraction tube onto the wettable roller, the liquid ink having an upper surface which normally lies below said threshold, said container being formed by two cavities of narrowing cross-sections, said cavities being joined to each other at the points of their smallest cross sectional areas, said points of smallest cross-sectional area forming said threshold.

2. An ink ribbon cassette as described in claim 1 wherein said cavities are connected by an air relief duct.

3. An ink ribbon cassette as claimed in claim 2 wherein said two cavities are in the form of hollow cones.

4. An ink ribbon cassette as claimed in claim 2 wherein said two cavities are in the form of hollow pyramids.

5. An ink ribbon cassette as claimed in claim 1 wherein said threshold is provided inside a tube which extends at right angles to said extraction tube.

6.An ink ribbon cassette as claimed in claim 5 wherein said threshold is constructed so as to be raised inside said second tube.

7. An ink ribbon cassette as claimed in claim 1 wherein said threshold is constituted by inclined surfaces declining towards a second tube into which the extraction tube opens, said second tube being arranged adjacent to the crest formed by said inclined surfaces.

* * * * *